United States Patent [19]

Stilts

[11] 4,084,368

[45] Apr. 18, 1978

[54] APPARATUS FOR INSULATING PURLINS

[76] Inventor: Kenneth Morris Stilts, P.O. Box 17087, Nashville, Tenn. 37217

[21] Appl. No.: 651,958

[22] Filed: Jan. 23, 1976

[51] Int. Cl.[2] ..... E04C 3/30; E04C 1/34

[52] U.S. Cl. ..... 52/728; 52/464; 52/732

[58] Field of Search ..... 52/728, 745, 464, 361, 52/490, 440, 441, 423, 727, 340, 732, 726, 725, 724, 145; 428/322

[56] References Cited

U.S. PATENT DOCUMENTS

| | | | |
|---|---|---|---|
| 573,127 | 12/1896 | Balph et al. | 52/340 |
| 1,491,198 | 4/1924 | Cassidy | 52/490 |
| 2,100,624 | 11/1937 | Beckwith | 52/725 |
| 2,366,149 | 12/1944 | Robertson et al. | 52/490 |
| 2,391,049 | 12/1945 | Weiller | 52/727 |
| 2,821,941 | 2/1958 | Reed | 52/727 |
| 3,040,849 | 6/1962 | Abberly | 52/727 |
| 3,179,983 | 4/1965 | Webber et al. | 52/727 |
| 3,217,456 | 11/1965 | Quigg et al. | 52/423 |
| 3,238,690 | 3/1966 | Wilkins | 52/727 |
| 3,327,441 | 6/1967 | Kelly | 52/727 |
| 3,328,086 | 6/1967 | Johnston | 428/322 X |
| 3,570,208 | 3/1971 | Sei Nikai et al. | 52/423 |
| 3,597,891 | 8/1971 | Martin | 52/145 |
| 3,606,418 | 9/1971 | Buker et al. | 52/726 |
| 3,908,327 | 9/1975 | Quigg | 52/727 |
| 3,922,828 | 12/1975 | Patton | 52/727 |

FOREIGN PATENT DOCUMENTS

| | | | |
|---|---|---|---|
| 983,409 | 2/1965 | United Kingdom | 52/727 |
| 557,609 | 11/1943 | United Kingdom | 52/724 |

*Primary Examiner*—Price C. Faw, Jr.
*Assistant Examiner*—Robert C. Farber
*Attorney, Agent, or Firm*—Sherman & Shalloway

[57] ABSTRACT

In metal buildings, a plurality of purlins project down into the building and, in effect, serve as heat exchange fins, which conduct heat into the building in warm climates, and heat out of the building in cold climates. In order to counteract this phenomenon, each purlin is covered with a separate blanket of insulating material, which is held in place with a flexible sleeve that is laminated to the blanket. Two additional flexible sliding sleeves are used to complete installation at each end of the purlin.

13 Claims, 3 Drawing Figures

APPARATUS FOR INSULATING PURLINS

BACKGROUND OF THE INVENTION

1. Field of the Invention

The instant invention relates to methods of and apparatus for insulating buildings. More particularly, the instant invention relates to methods of and apparatus for insulating buildings, wherein the skeletal structure of buildings is insulated to prevent heat transfer either into or out of the buildings.

2. Technical Considerations and Prior Art

Metal buildings necessarily have high heat transfer rates through their metallic walls and roofs. Consequently, it is necessary to extensively insulate metal buildings, so as to prevent excessive heat transfer. In warm climates, considerable energy is necessary to cool these buildings, and in cooler climates considerable energy is necessary to heat these buildings. In order for metal buildings to be economically utilized with their concomitant advantages, it is continuously necessary to devise ways to limit energy consumption.

In metal buildings a great deal of energy is lost through the roof due to exposed metal purlins which support panels forming the roof. These purlins extend down into the building and, in effect, turn the building into a finned heat exchanger, in which the interior surface of the roof is greatly increased by the surface area of the purlins. This increased surface area due to the purlins increases the area over which both radiant and convective heat transfer takes place between the environment within the building and the purlins. In a cool climate, where the environment in the building is maintained warmer than the atmosphere, the purlins conduct heat transferred thereto out into the atmosphere. In a warm climate, where the environment of the building is maintained cooler than the atmosphere, the purlins conduct heat into the building and, by both radiation and convection, transfer the heat to the environment within the building.

The prior art, while concerned with reducing heat transfer from metal buildings to the atmosphere, has failed to recognize the aforementioned analogy between a building and a finned heat exchanger and, therefore, has not corrected the problem. In the prior art, insulation has been placed on top of the purlins, underneath the purlins and between the purlins. Generally, the purlins are Z-shaped with a main web portion and top and bottom flange portions which project in opposite directions from the web portion. In placing the insulation between the purlins, the bottom flange portion is, in the prior art, always left exposed, so that heat is readily conducted from the bottom flange through the web to the roof structure and into the atmosphere.

OBJECTS OF THE INVENTION

In view of these and other considerations, it is an object of the instant invention to provide new and improved methods of and apparatus for insulating buildings.

It is an additional object of the instant invention to provide new and improved methods of and apparatus for insulating a building, wherein the skeletal structure of the building is insulated in such a way, so as to prevent the skeletal structure from serving as a finned heat exchanger, which transfers heat out of the building, in cold climates, and into the building, in warm climates.

It is still another object of the instant invention to provide a new and improved method of and apparatus for insulating metal buildings, wherein energy consumption for regulating the climate within these buildings, is drastically reduced.

It is another object of the instant invention to provide a new and improved method of and apparatus for insulating buildings, wherein insulation may be applied to structural members, such as purlins, prior to installing the purlins.

SUMMARY OF THE INVENTION

In view of these and other objects, the instant invention contemplates a method of and apparatus for insulating buildings, wherein the buildings have a plurality of metal purlins, supporting the roof thereof, and extending into the interior of the building. In accordance with the instant invention, a blanket of thermal insulating material is formed around each purlin to insulate the purlin before installing the purlin in the building. The blanket may be enclosed in a flexible sleeve to form a tubular assembly which is slid over the purlin.

DETAILED DESCRIPTION

Figure 1:
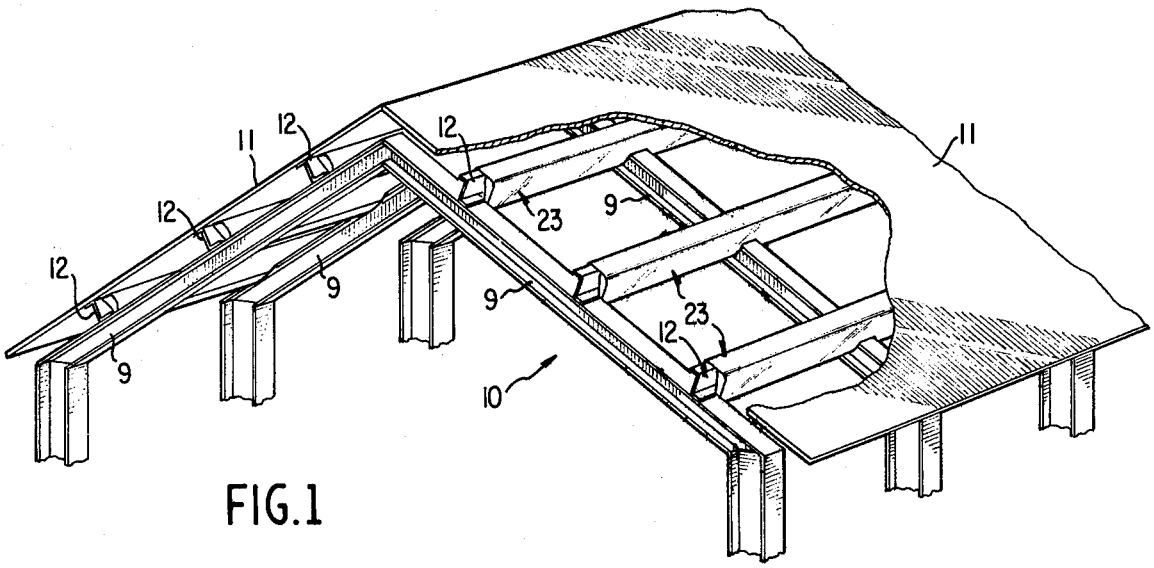
FIG. 1 is a perspective view of a roof structure partially cut away, in which a plurality of purlins support a roof surface.

Referring now to FIG. 1, there is shown a roof structure, designated generally by the numeral 10, of a building which, for the purposes of this disclosure, is a metallic building. The roof structure consists of metal roof sheets or panels 11, which are secured to a plurality of purlins 12 by screws 13 or the like. The purlins 12 are supported by and secured to rafters 9. As is seen in FIG. 1, the purlins 12 project down into the interior of the building and thus function like heat exchanger fins, which tend to conduct exterior environmental conditions into the interior of the building. If the exterior environment is colder than the interior of the building, the purlins 12 will absorb heat by radiation and convection from the interior of the building, and conduct the heat to the roof panels 11 and into the environment. If the environment is hotter than the interior of the building, the purlins 12 conduct heat from outside of the building into the inside of the building, and release the heat by convection and radiation to the atmosphere inside of the building. Since there are many purlins 12, the surface area of the roof structure 10 is greatly increased and a large portion of that surface area extends into the interior of the building, where convective currents of air will flow thereover and increase heat transfer rates accordingly.

Preferably, the roof panels 11 are secured directly to the purlins 12 by screws 13 and preferably no insulation is used to break the thermal path between the panels 11 and the purlins. Direct contact is preferable, because it provides a rigid structure which will not shake and move objectionably, when thermal expansion and contraction, high winds, machinery in the building, or the like, apply forces to the building. Since these forces move the building, the screws 13 holding the roof panels 11 tend to work within the screw holes in the roof panels, thereby enlarging the holes. These enlarged holes provide paths, through which heat can escape from the building by convection, and by which rain water can enter the building.

Figure 2:
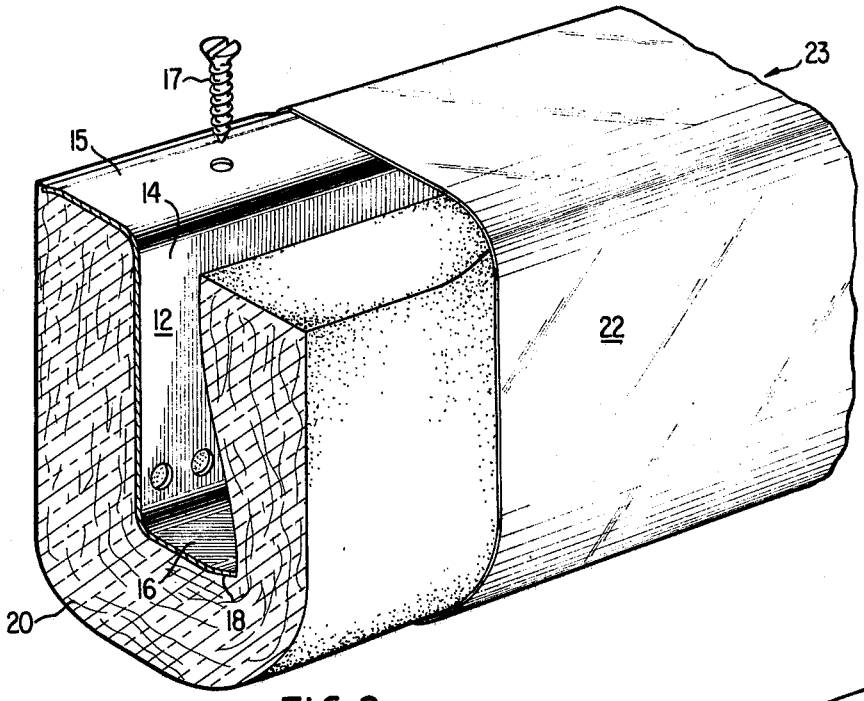
FIG. 2 is a perspective view of a portion of an insulated purlin, in accordance with the instant invention, which is utilized in a roof structure, such as that of FIG. 1.

Referring now to FIG. 2, a portion of one of the purlins 12 is shown. The purlin 12 has a Z-cross section, in which a web 14, which provides bending strength for the purlin, has oppositely directed flanges 15 and 16 attached at the ends thereof. A great deal of heat can be transferred both by the screws themselves and contact between the purlins 12 and roof panels 11. The flange 15 is an upper flange, upon which the roof panels 11 (FIG. 1) rest. The screws 13 or perhaps rivets, or the like, pass through holes in the upper flange 15 and through holes in the roof panels to secure the roof panels 11 in place.

The lower flange 16 projects in the opposite direction from the upper flange 15, in order that a plurality of purlins 12 may be easily stacked for shipping purposes. The lower flange 16 has a lip 18 that projects upward obliquely relative to the lower flange.

In order to insulate a building having a plurality of purlins 12, such as the building of FIG. 1, each purlin is covered with a blanket of insulation 20. The insulation is preferably made of fiberglass and extends from beneath the top flange 15, down along the side of the web 12, beneath the bottom flange 16 and back up to a level substantially even with the upper flange 15. In this way, the entire portion of the purlin 12, which extends into the building, is thermally insulated from the atmosphere of the building.

According to a preferred embodiment of the invention, the blanket of insulation 20 is encased in a flexible sleeve 22, which may be made of a material, such as plastic. The insulation 20 and sleeve 22 are preferably laminated to one another to form a tubular assembly, designated generally by the numeral 23. This tubular assembly does not include a purlin 12 and generally is manufactured at a different location than the purlins. Preferably, the tubular assembly 23 is slid over a purlin 12 at the building site, before the purlin is installed with other purlins over the rafters 9. It has been found more desirable to form the assembly 23 by using an adhesive between the inside of the sleeve 22 and the outside of the blanket 20, in order to properly position the blanket within the sleeve. It is, however, certainly within the scope of this invention to slide the sleeve 22 over the blanket 20 and retain it there by friction.

Figure 3:
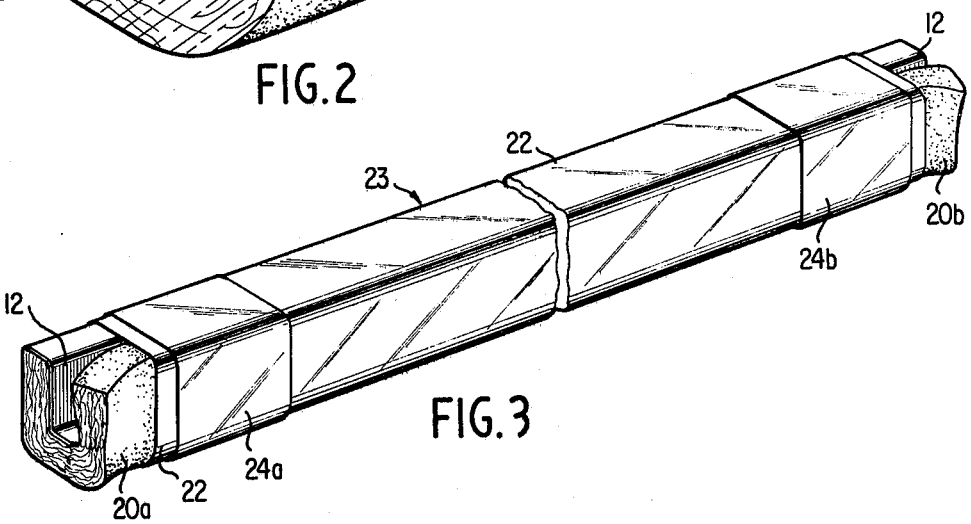
FIG. 3 is a perspective view of a single purlin insulated in accordance with the principals of the instant invention.

Referring now to FIG. 3, a purlin 12 is shown with a tubular assembly 23 slid thereover. The tubular assembly 23 is shown with portions **20*a* and 20*b* of the insulation blanket 20 projecting beyond the sleeve 22 to which the blanket is laminated. The projecting portions 20*a* and 20*b* may be easily moved aside by workmen installing the purlin 12 to provide the workmen easy access to the purlin without undue interference from the assembly 23, which has been slid over the purlin, while on the ground. After the purlin 12 has been secured in the usual manner between or over the rafters 9, the end portions 20*a* and 20*b* of the insulation 20 are pulled up around the purlin and sleeves 24*a* and 24*b* are slid over the end portions. The sleeves 24*a* and 24*b* are slidably mounted over the sleeve 22 and are preferably included on the assembly 23** when it is shipped.

Preferably, the sleeve 22 and the sleeves **24*a* and 24*b* are made of a flexible plastic material, such as vinyl, and are white in color to both reflect heat and provide a pleasing appearance, if left exposed. The sleeves may, of course, be made of other flexible materials and may have any convenient and well-known structure. Generally, the insulating blanket 20 will have an uncompressed thickness of approximately four inches, which is slightly and non-uniformly reduced upon sliding the sleeve 22** thereover.

In practice, it has been found that in a building, heat losses are drastically reduced when the building is insulated in accordance with the principles of this invention, wherein each purlin is covered with insulation over that area of the purlin extending into the building. In addition, the invention may be put into practice with ease, since the tubular assembly 23, formed by laminating blanket 20 and sleeves 22, can be slid over the purlins 12, while the purlins are on the ground and before the purlins are installed. This, of course, results in labor savings, because relatively unskilled personnel can insulate the purlins. Accordingly, the methods and apparatus of the instant invention provide great savings in energy consumption.

What is claimed is:

1. A purlin insulated to reduce heat transfer from outside of a building into the building and from inside the building to outside of the building, said purlin including:

a blanket of flexible thermal insulating material folded around the purlin; and a sleeve of thin flexible material surrounding the blanket to hold the blanket in place on the purlin.

2. The purlin of claim 1, wherein the purlin has a main web, an upper flange and a lower flange, and wherein the blanket is generally U-shaped and is formed around the purlin to cover all surfaces of the purlin with the exception of the top surface of the upper flange.

3. The purlin of claim 2 wherein the blanket is made of fiberglass.

4. The purlin of claim 1, wherein the sleeve and blanket are in the form of a performed laminate, wherein the sleeve and blanket are held together by an adhesive to form a tubular assembly, which is slid over the purlin before the purlin is installed.

5. The purlin of claim 4 wherein the blanket is made of fiberglass.

6. The purlin of claim 4, wherein portions of the blanket project beyond the sleeve adjacent the ends of the purlin, and wherein auxiliary sleeves are disposed around the tubular assembly and slid thereover after the purlin is installed.

7. The purlin of claim 6 wherein the blanket is made of fiberglass.

8. Apparatus for thermally insulating purlins from environmental temperature gradients between the inside and outside of a building, wherein the apparatus comprises:

a tubular assembly including a blanket of insulating material folded into a U-shape surrounded by a thin flexible sleeve, wherein the tubular assembly is slid over the purlin before the purlin is installed.

9. The apparatus of claim 8, wherein the blanket is adhered to the sleeve to form a laminate.

10. The apparatus of claim 9 wherein the blanket is made of fiberglass.

11. The apparatus of claim 9, wherein portions of the blanket project beyond each end of the sleeve, and wherein auxiliary slidable sleeves are provided over the assembly for covering the projecting portions of the blanket after the purlin is installed.

12. The apparatus of claim 11 wherein the blanket is made of fiberglass.

13. The apparatus of claim 8 wherein the blanket is made of fiberglass.

* * * * *